US012276443B2

(12) United States Patent
Schmidt et al.

(10) Patent No.: US 12,276,443 B2
(45) Date of Patent: Apr. 15, 2025

(54) GEOTHERMAL SYSTEM AND METHOD

(71) Applicant: Quidnet Energy Inc., Houston, TX (US)

(72) Inventors: Howard K. Schmidt, Hockley, TX (US); Aaron H. Mandell, Walnut, CA (US)

(73) Assignee: Quidnet Energy, Inc., Houston, TX (US)

( * ) Notice: Subject to any disclaimer, the term of this patent is extended or adjusted under 35 U.S.C. 154(b) by 266 days.

(21) Appl. No.: 17/677,635

(22) Filed: Feb. 22, 2022

(65) Prior Publication Data

US 2022/0268489 A1 Aug. 25, 2022

Related U.S. Application Data

(60) Provisional application No. 63/151,574, filed on Feb. 19, 2021.

(51) Int. Cl.

| | |
|---|---|
| ***E21B 43/26*** | (2006.01) |
| ***E21B 36/00*** | (2006.01) |
| ***E21B 43/267*** | (2006.01) |
| ***F24T 10/20*** | (2018.01) |

(52) U.S. Cl.

CPC ..... *F24T 10/20* (2018.05); *E21B 36/00* (2013.01); *E21B 43/267* (2013.01)

(58) Field of Classification Search

CPC ..... F24T 10/20; E21B 36/00; E21B 43/267; Y02E 10/10

See application file for complete search history.

(56) References Cited

U.S. PATENT DOCUMENTS

| | | | |
|---|---|---|---|
| 7,520,327 | B2 | 4/2009 | Surjaatmadja |
| 7,753,122 | B2 | 7/2010 | Curlett |
| 7,849,690 | B1 | 12/2010 | Lakic |
| 9,190,181 | B2 | 11/2015 | Germanovich et al. |
| 10,669,471 | B2 * | 6/2020 | Schmidt ..... E21B 41/0057 |
| 2013/0056171 | A1 * | 3/2013 | Klemencic ..... F24T 10/30 165/45 |

FOREIGN PATENT DOCUMENTS

WO 2014126484 A1 8/2014

OTHER PUBLICATIONS

Anderson, R., Ingram, D., Zanier, A., 1973. Determining fracture pressure gradients from well logs. J. Pet. Technol. 25, 1259-1268.

(Continued)

*Primary Examiner* — Carib A Oquendo
(74) *Attorney, Agent, or Firm* — Tumey L.L.P.

(57) ABSTRACT

A system and method for geothermal resource development which comprises generating a plunging fracture at a wellbore using a dense fracture fluid. In one embodiment a compliant elastic material may be pushed to the propagating tips of fractures where they screen out the fracture tip and stop fracture propagation. The method may further comprise injecting additional fluid to increase the net pressure in the fracture, thereby increasing the width of the fracture. The system may further comprise providing a heat exchanger disposed about the bottom of the wellbore or providing an apparatus for circulating water into the fracture in order to address natural convection occurring in the fracture.

7 Claims, 1 Drawing Sheet

| Rock Type | Rock Density | Lithostatic Gradient | Hydrostatic Gradient | Biot's Constant | Poisson's Ratio | $S_{hmin}$ | Equiv. Mud Weight | Equiv. Mud density |
|---|---|---|---|---|---|---|---|---|
| units | g/cc | PSI/foot | PSI/foot | | | PSI/foot | Pound/gallon | grams/cc |
| Shallow sedimentary | 2.31 | 1.00 | 0.433 | 0.8 | 0.25 | 0.56 | 10.9 | 1.30 |
| Intermediate sedimentary | 2.4 | 1.04 | 0.433 | 0.8 | 0.25 | 0.58 | 11.1 | 1.33 |
| Intermediate sedimentary - overpressured | 2.4 | 1.04 | 1 | 0.8 | 0.25 | 0.88 | 17.0 | 2.03 |
| Deep sediementary | 2.5 | 1.08 | 0.433 | 0.25 | 0.25 | 0.43 | 8.3 | 1.00 |
| Deep sedimentary - overpressured | 2.5 | 1.08 | 1 | 0.15 | 0.25 | 0.46 | 8.9 | 1.06 |
| Intermediate - deep igneous | 2.75 | 1.19 | 1.19 | 0.05 | 0.25 | 0.44 | 8.4 | 1.01 |
| Very deep igneous - ductile | 3 | 1.30 | 1.3 | 0.05 | 0.5 | 1.30 | 25.0 | 3.00 |

(56) References Cited

OTHER PUBLICATIONS

Thiercelin, M., Plumb, R., 1994. A core-based prediction of lithologic stress contrasts in east Texas formations. In: SPE Formation Evaluation. 9. pp. 251-258 SPE 21847.

Zhou, Y., Nikoosokhan, S., Tan, Y., Johnston, T. and Engelder, T., 2018. The correlation between low tectonic stress and the Appalachian Basin Quiet Zone. Tectonophysics, 745, pp. 95-116.

Heidbach, O., Rajabi, M., Cui, X., Fuchs, K., Muller, B., Reinecker, J., Reiter, K., Tingay, M., Wenzel, F., Xie, F. and Ziegler, M.O., 2018. The World Stress Map database release 2016: Crustal stress pattern across scales. Tectonophysics, 744, pp. 484-498.

Limberger, J., Boxem, T., Pluymaekers, M., Bruhn, D., Manzella, A., Calcagno, P., Beekman, F., Cloetingh, S. and van Wees, J.D., 2018. Geothermal energy in deep aquifers: A global assessment of the resource base for direct heat utilization. Renewable and Sustainable Energy Reviews, 82, pp. 961-975.

Aghahosseini, A. and Breyer, C., 2020. From hot rock to useful energy: A global estimate of enhanced geothermal systems potential. Applied Energy, 279, p. 115769.

Nguyen, T.S., Li, Z., Su, G., Nasseri, M.H.B. and Young, R.P., 2018. Hydro-mechanical behavior of an argillaceous limestone considered as a potential host formation for radioactive waste disposal. Journal of Rock Mechanics and Geotechnical Engineering, 10(6), pp. 1063-1081.

Luo, X., Were, P. and Hou, Z.M., 2015. Estimation of Biot's Effective Stress Coefficient from Well Logs. Environ Earth Sci 73 (11): 7019-7028.

Ji, S., Wang, Q. and Salisbury, M.H., 2009. Composition and tectonic evolution of the Chinese continental crust constrained by Poisson's ratio. Tectonophysics, 463(1-4), pp. 15-30.

Alkinani, H.H., 2017. A Comprehensive Analysis of Lost Circulation Materials and Treatments with Applications in Basra's Oil Fields, Iraq: Guidelines and Recommendations. Missouri University of Science and Technology.

International Search Report and Written Opinion for Application No. PCT/US2022/017366 dated Jul. 14, 2022.

Nagy. "Porosity and permeability of the Early Precambrian Onverwacht chert: Origin of the hydrocarbon content" 525-527. Geochimica et Cosmochimica Acta. [online}. 1970; vol. 34, Issue 4; pp. 525-527; [Retrieved on Jun. 23, 2022]. Retrieved from the internet: <https://www.sciencedirect.com/science/article/abs/pii/001670377090-1444#:-:text=A%20representative%20sample%20of%20the,5.7%20%C3%97%2010%E2%88%927%20millidarcy.>; p. 1 para. 3; DOI: 10.1016/0016-7037(70)90144-4.

LoGo. "Estimation of the Poisson's Rate of the Intact Rock in the Function of the Rigidity" 1030-1038. Periodica Polytechnica Civil Engineering. [online]. Oct. 2019; vol. 63, No. 4; pp. 1030-1037; [Retrieved on Jun. 23, 2022]. Retrieved from the internet < url:https://pp.bme.hu/ci/article/view/14946>; entire document; DOI: 10.3311/PPci.14946.

Montgomery. "Fracturing Fluids" 1-24. IntechOpen. [online]. May 17, 2013; [Retrieved on Jun. 23, 2022]. Retrieved from the internet: <url: https://www.intechopen.com/chapters/44353>; entire document; DOI: 10.5772/56192.

Schlumberger. "FiberFRAC fracturing fluid technology" 1-2 . . . [online]. 2014; [Retrieved on Jun. 23, 2022]. Retrieved from the internet <url:https:www.slb.com/-/media/files/stimulation/product-sheeUfiberfrac_ps.ashx>; entire document.

* cited by examiner

| Rock Type | Rock Density | Lithostatic Gradient | Hydrostatic Gradient | Biot's Constant | Poisson's Ratio | $S_{hmin}$ | Equiv. Mud Weight | Equiv. Mud density |
|---|---|---|---|---|---|---|---|---|
| units | g/cc | PSI/foot | PSI/foot | | | PSI/foot | Pound/gallon | grams/cc |
| Shallow sedimentary | 2.31 | 1.00 | 0.433 | 0.8 | 0.25 | 0.56 | 10.9 | 1.30 |
| Intermediate sedimentary | 2.4 | 1.04 | 0.433 | 0.8 | 0.25 | 0.58 | 11.1 | 1.33 |
| Intermediate sedimentary - overpressured | 2.4 | 1.04 | 1 | 0.8 | 0.25 | 0.88 | 17.0 | 2.03 |
| Deep sedimentary | 2.5 | 1.08 | 0.433 | 0.25 | 0.25 | 0.43 | 8.3 | 1.00 |
| Deep sedimentary - overpressured | 2.5 | 1.08 | 1 | 0.15 | 0.25 | 0.46 | 8.9 | 1.06 |
| Intermediate - deep igneous | 2.75 | 1.19 | 1.19 | 0.05 | 0.25 | 0.44 | 8.4 | 1.01 |
| Very deep igneous - ductile | 3 | 1.30 | 1.3 | 0.05 | 0.5 | 1.30 | 25.0 | 3.00 |

GEOTHERMAL SYSTEM AND METHOD

CROSS-REFERENCE TO RELATED APPLICATIONS

This application claims priority to U.S. Provisional Patent Application Ser. No. 63/151,574 filed Feb. 19, 2021, the entire contents of which are incorporated herein by reference thereto.

STATEMENT REGARDING FEDERALLY SPONSORED RESEARCH OR DEVELOPMENT

Not applicable.

BACKGROUND OF THE INVENTION

Field of the Invention

The present invention relates to systems and methods for developing geothermal resources, and more specifically to fracturing and preparing geothermal resources for use in geothermal energy systems.

Background of the Invention

Geothermal systems hold the potential of providing a viable source of abundant, sustainable, and reliable energy, and present a number of advantages over competing energy sources, for example generating lower carbon emissions in comparison to natural gas, and providing consistent availability that cannot be matched by prevailing wind- and solar-based technologies. Yet, despite these advantages geothermal systems remain an under-developed source of energy worldwide. For example, U.S. government agency reporting suggests that geothermal capacity in excess of 100 Gigawatts of electric energy may be available in the United States alone, yet less than 1% of geothermal electricity resources have been developed for production.

Two prevailing limitations are often cited as hindrances to more widespread development of geothermal resources. First, sources of geothermal energy are naturally constrained based upon prevailing geological considerations which typically dictate or substantially influence where power plants may be built. Second, while typical operation and maintenance costs for geothermal power plants may be in-line with or lower than other producing technologies, the capital commitments to initially construct a geothermal plant can be substantial. Exploration, resource assessment, drilling, construction of field infrastructure and production facilities, and connection to the power grid must all be undertaken prior to bringing a geothermal generation facility online, and of these, a major limiting cost for geothermal systems involves drilling to reach formations providing sufficient sources of heat.

Consequently, there is a need for improved systems and methods of drilling geothermal systems that offer more cost-effective solutions than those prevailing in the art.

BRIEF SUMMARY OF SOME OF THE PREFERRED EMBODIMENTS

These and other needs in the art are addressed in one embodiment by a geothermal system and method which comprises generating a plunging fracture at a wellbore using a dense fracture fluid, whereby compliant elastic material may be pushed to the propagating tips of fractures in order to screen out the fracture tip and stop fracture propagation. The method may further comprise injecting additional fluid to increase the net pressure in the fracture, thereby increasing the width of the fracture. The system may further comprise providing a heat exchanger disposed about the bottom of the wellbore or providing an apparatus for circulating water into the fracture in order to address natural convection occurring in the fracture.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which:

FIG. 1 illustrates estimations of fracture gradients and equivalent mud weights for neutral fracturing fluids for generalized rock types.

DETAILED DESCRIPTION OF THE PREFERRED EMBODIMENTS

The geothermal system and method disclosed herein comprises generating one or more "plunging" fractures at the bottom of a wellbore using a dense fracture fluid. In embodiments, the wellbore may be drilled to an appropriate depth such that the plunging fracture may extend downward to reach a desired zone of a rock formation favorable for geothermal energy production, and the fracture may be formed hydraulically through work and pressure applied to a fluid injected into the formation. For example, the wellbore may be drilled to a depth between 10,000 and 15,000 feet, or 3 to 5 kilometers, generally bypassing high porosity and high permeability strata, with a formation favorable for geothermal energy production being located below. In order to develop the fracture, the density of the fracture fluid is desired to match or exceed the fracture gradient of the rock matrix below the wellbore, causing the fracture to propagate mostly downward instead of sideways or vertically as may be typical during fracture operations. The fracturing fluid may be injected with applied pressure to increase the rate of fracture propagation and inflate the fracture. In favorable rock formations, the resulting plunging fractures may extend downward up to several thousand feet.

A fracture gradient may be determined by the magnitude of the least principal stress. Near the surface, the minimum stress is usually in the vertical direction, $S_v$, and hydraulic fractures propagate horizontally. In sedimentary rocks with reasonable porosity, density may commonly be around 2.3 g/cc, resulting in a vertical lithostatic gradient of about 1 PSI/foot. At substantial depths of more than one to three thousand feet, however, the minimum stress direction may be in the horizontal plane, denoted $S_{h\ min}$, and may be determined based upon a relationship involving the stress in the vertical direction, $S_v$, the pore pressure of the rock matrix, $P_p$, Poisson's ratio, ν, and Biot's constant for the rock matrix, α, as follows:

$$S_{h\,min} = \frac{\nu}{1-\nu}(S_v - \alpha P_p) + \alpha P_p$$

For most rocks, whether igneous or sedimentary, Poisson's ratio may range from 0.20 to 0.30, and may be close to 0.25. An exception to this can be found when a rock matrix may be visco-plastic and can flow, for example certain organic rich shales, or thermally softened rocks near a brittle-ductile transition zone which may be found at great depth. Biot's constant, which is related to poroelasticity, can range widely. Fairly porous sedimentary rocks may exhibit a Biot's constant in the vicinity of 0.8, while low porosity igneous rocks may range from 0.1 to 0.2, and essentially non-porous rocks like anhydrite and basement granites being close to zero. The pore pressure, in the absence of overpressure effects, can usually be approximated by a hydrostatic column, or 0.433 PSI/foot. In extreme cases of overpressure, the pore pressure can be as great as the lithostatic gradient, but this is typically quite unusual. Finally, under certain conditions, the minimum horizontal stress $S_{h\ min}$ can be modulated by tectonic stress, where compression may increase $S_h$ min while tension may decrease $S_{h\ min}$.

FIG. 1 illustrates a table of estimated fracture gradients and equivalent mud weights for neutral fracturing fluids for generalized rock types based on these relationships. As can be seen, for most rocks and depths, with noted exceptions for overpressure zones and those approaching the brittle-ductile transition zone, fracture gradients are quite low and plunging gravity fractures can be generated without exotic, high density fracturing fluids as may be known in the art. For example, U.S. Pat. No. 9,190,181 to Germanovich et. al. discloses the use of fluids having densities greater than the matrix rock for generating plunging fractures for nuclear waste disposal, and U.S. Patent Publication No. 2021/0396430 to Cook et. al. discloses the use of exotic heavy metal brines to form multiple dense slurries with densities up to 2.5 and 3.0, along with proppants with high thermal conductivity, for generating plunging fractures for accessing geothermal resources. Referring again to FIG. 1, it can be seen that plunging fractures may be generated using affordable, lower density fluids and slurries. In situations, plunging fractures can be generated using at most "kill fluids" commonly employed in the oil field, for example white muds having densities of 10.1-14.9 PPG (pounds per gallon) or red muds having densities of 15-24 PPG. Presenting extremely attractive targets for geothermal resources, deep but brittle igneous rocks with negligible (less than one percent) porosity could be accessible with fracturing fluids only slightly denser than clean water, and these conditions can be relaxed still further in provinces with tensile tectonic stress. Since geothermal resources are broadly distributed, an embodiment based on lower density fracturing fluids may be exploited in provinces with a combination of hot rocks along with neutral to tensile stress regimes.

Formation thermal properties may vary greatly based upon the type of rock under consideration as a geothermal resource. In embodiments, the system and method disclosed herein may be applied to formations comprising, for example, shale, granite, or other suitable types of rock formation. Typically, shale formations may exhibit lower heat capacity and lower thermal conductivity, while granite formations may exhibit higher heat capacity and higher thermal conductivity. In embodiments, the rock may have a constant density, and may range between 2.2 and 2.75, and density may increase slightly with depth. Further, rock temperatures may vary linearly with depth, wherein a geothermal gradient may range between 25 to 30 C/km, and favorable rock formations may exhibit a geothermal gradient twice that range.

In addition to the thermal properties of a formation being considered for use as a geothermal resource, the fluid characteristics of a selected working fluid may be considered. For example, characteristics such as density and viscosity may vary with temperature and pressure. In embodiments comprising water as a working fluid, density may vary with temperature ranging from 958 kg/m$^3$ at 100 C, to 862 kg/m$^3$ at 200 C, to 724 kg/m$^3$ at 300 C. Further, while the viscosity of water may decrease with temperature, its viscosity may remain constant or near-constant with changes in pressure. In embodiments, the working fluid may be enhanced with additives such as salt to increase the density of the working fluid to match that of the rock at the average temperature of the fluid in the system.

Such characteristics of a selected working fluid may be considered in implementing the geothermal system and method disclosed herein due to a natural convection cycle which may occur as a result of a temperature gradient present in the fracture and based upon the type of rock which the formation comprises. As previously described, in embodiments the density of the working fluid in the fracture may vary with temperature, and pressure changes may result as well. Depending upon the working fluid selected, increases in temperature may tend to decrease density, and thus pressure, and thus the width of the fracture toward the bottom of the fracture zone. Similarly, decreases in temperature toward the top of the fracture zone may tend to increase density, and thus pressure, and thus the width of the fracture. Such convective mass and/or heat transfer within the fracture can be problematic.

The method may further comprise treating the fracture to stop propagation and inflating the fracture to generate an open ellipsoid. The cross-section of the ellipsoid may generally be in the shape of a convex lens, wherein the perimeter may have zero width and the center may have some maximum value. In embodiments, fracture lateral width may range from 300 to 1,000 meters, and fracture length may vary between 1,000 and 5,000 meters. Additionally, the wellbore may penetrate some distance into the fracture zone, for example a well may penetrate 100 meters into the fracture zone.

The fracture thickness may be controlled by a pressure applied within the fracture which will vary with depth and temperature of the working fluid. In embodiments, a screening slurry including one or more compliant materials or particulates may be pushed to the propagating tips of a fracture such that they screen out the fracture tip and stop fracture propagation, allowing additional fluid to be pumped into the fracture, thereby increasing net pressure in the fracture and pushing the rock out further to increase the thickness of the fracture. In such embodiments, a typical fracture normally 1 millimeter thick may be expanded to several centimeters. For example, a maximum fracture thickness may vary from 2.5 centimeters to 10 centimeters. Such compliant screening materials may be augmented by solid or rigid particles to promote bridging and filtration as well as other materials and particulates commonly employed as lost circulation materials and mixtures, for example additives including fibers or sheets. In certain embodiments, the compliant materials may be elastic, for example rubber, silicone rubber, or organic polymers, or may swell upon being injected into the fracture. In alternate embodiments, the fracture may be filled with material such as sand or gravel. In such embodiments the proppant bed may substantially reduce flow within the fracture. Alternatively, permeability may be increased wherein the proppant bed may comprise large particles. For example, permeability may be increased to 1 Darcy or greater.

The system disclosed herein may further comprise providing a means of addressing the natural convection resulting from the temperature gradient in the rock across the depth of the well and fracture to produce energy or work, or perform useful work, at the surface via a primary working fluid. In embodiments employing a closed loop configuration, addressing the natural convection may comprise disposing a heat exchanger at or near the bottom of the well or the top of the fracture, wherein the heat exchanger may act as a cold finger, for example approximately 50% cooler than the initial rock temperature at the top of the fracture. In a closed loop configuration, a primary working fluid such as water may be circulated from the surface through the well to the heat exchanger and back to the surface in order to heat the primary working fluid. Embodiments of a closed loop configuration may further employ the fracture fluid or a secondary working fluid circulating through the fracture and heat exchanger to transfer heat to the primary working fluid via the heat exchanger. In alternate embodiments employing an open loop configuration, the means of addressing the natural convection may comprise circulating a primary working fluid such as water into the fracture through tubing and extracting the circulated water through a wellbore annulus. In such embodiments the primary working fluid may be injected for example 100 meters below the top of the fracture zone to be circulated through the fracture, and the circulated fluid, once heated, may be extracted from the top of the fracture zone. More complex embodiments may comprise a combination of both the heat exchanger and forced convection cooling fluid embodiments, and wellbore configurations may comprise one or more boreholes, coaxial casing, coaxial tubing, or combinations thereof.

In example embodiment, a system may be formed below an open wellbore at convenient depth (for example 15,000 feet) in a low porosity (for example less than 5%) sedimentary stratum by injecting a mixture of finely ground calcium carbonate based "white mud" loaded with 10 volume % rubber particles ranging in size from 0.05 mm to 2.5 mm, the mixture having a density of 10 to 14 PPG. The A volume sufficient to generate a fracture to a depth of 25,000 feet may then be injected. The fracture may be expanded until thermal effects increase the Poisson ratio of the rock matrix and downward growth is terminated by increasing fracture gradient and fracture toughness. The fracture may be initiated with a pad of white mud of low viscosity, followed by the rubbery and screening additives. The mixture may serve to limit and seal lateral growth of the fracture while promoting downward fracture extension. After formation of the fracture, the fluid may be circulated with white mud of somewhat lower density and without the screening particulates and pressure adjusted to optimize convective flow in the fracture without further propagation.

Although the present invention and its advantages have been described in detail, it should be understood that various changes, substitutions and alterations may be made herein without departing from the spirit and scope of the invention as defined by the appended claims.

What is claimed is:

1. A method of producing work from a geothermal resource, comprising:

locating a rock formation suited for development as a geothermal resource;

drilling a wellbore which allows the rock formation to be accessible via a plunging fracture generated from the wellbore, wherein the plunging fracture is sited in a zone with tectonic stress;

generating the plunging fracture from the wellbore at a depth of 15,000 feet in a sedimentary stratum with a porosity less than 5% by injecting a mixture of finely ground calcium carbonate based "white mud" loaded with 10 volume % rubber particles ranging in size from 0.05 mm to 2.5 mm, wherein the mixture comprises a density between 10 PPG and 14 PPG, and further wherein the mixture generates a fracture to a depth of 25,000 feet, expanding the plunging fracture until thermal effects increase the Poisson ratio of the rock formation, and terminating downward growth of the plunging fracture by increasing fracture gradient and fracture toughness, wherein the plunging fracture provides access to the rock formation via the wellbore; and producing work from the rock formation in an open loop configuration, wherein the producing comprises circulating a fluid into the fracture at a depth 100 meters below the top of the fracture via the wellbore to convert the fluid to a heated fluid, recovering the heated fluid from the fracture at the top of the fracture via the wellbore, producing work from the heated fluid, and returning the heated fluid to the fracture via the wellbore.

2. The method of claim 1, wherein the wellbore comprises a single borehole, coaxial casing, and coaxial tubing.

3. A method of producing work from a geothermal resource, comprising:

locating a rock formation suited for development as a geothermal resource;

drilling a wellbore which allows the rock formation to be accessible via a plunging fracture generated from the wellbore;

generating the plunging fracture from the wellbore by injecting a mixture of finely ground calcium carbonate based "white mud" loaded with 10 volume % rubber particles ranging in size from 0.05 mm to 2.5 mm, wherein the mixture comprises a density between 10 PPG and 14 PPG, wherein the plunging fracture provides access to the rock formation via the wellbore; and producing work from the rock formation in a closed loop configuration, wherein the closed loop configuration comprises a heat exchanger disposed about a bottom of the wellbore or a top of the fracture, wherein the producing comprises circulating a primary fluid into the heat exchanger via the wellbore to convert the fluid to a heated fluid, recovering the heated fluid from the heat exchanger via the wellbore, producing work from the heated fluid, and returning the heated fluid to the heat exchanger via the wellbore, wherein a secondary working fluid is circulated through the fracture and heat exchanger to transfer heat to the primary working fluid via the heat exchanger.

4. The method of claim 3, wherein the wellbore comprises a single borehole, coaxial casing, and coaxial tubing.

5. The method of claim 3, wherein the plunging fracture is sited in a zone of tectonic stress.

6. The method of claim 5, wherein the zone of tectonic stress has a porosity of less than five percent.

7. The method of claim 6, wherein the zone of tectonic stress also has a Poisson ratio less than 0.3.

* * * * *